US005640772A

United States Patent [19]

Roeker et al.

[11] Patent Number: 5,640,772

[45] Date of Patent: Jun. 24, 1997

[54] CUTTING TOOL AND METHOD FOR MANUFACTURE

[75] Inventors: David C. Roeker, Troy Township, St. Croix County, Wis.; Edward L. Manor, Lakeland; Shawn P. Crosby, St. Paul, both of Minn.

[73] Assignee: Minnesota Mining and Manufacturing Company, St. Paul, Minn.

[21] Appl. No.: 423,206

[22] Filed: Apr. 17, 1995

Related U.S. Application Data

[63] Continuation-in-part of Ser. No. 235,167, Apr. 29, 1994, Pat. No. 5,469,623.

[51] Int. Cl.[6] ..... B26B 3/00

[52] U.S. Cl. ..... 30/169; 30/342; 76/119

[58] Field of Search ..... 30/169, 342, 344, 30/337; 76/119, 104.1; 15/236.01, 236.02

[56] References Cited

U.S. PATENT DOCUMENTS

| | | | |
|---|---|---|---|
| 833,869 | 10/1906 | Bowen | 30/169 |
| 2,264,374 | 12/1941 | Henschell | 30/169 |
| 2,335,872 | 12/1943 | Mitchell | 30/342 |
| 3,782,482 | 1/1974 | Miller | 30/342 |
| 5,219,378 | 6/1993 | Arnold | 30/169 |
| 5,469,623 | 11/1995 | Roeker et al. | 30/169 |

FOREIGN PATENT DOCUMENTS

| | | | |
|---|---|---|---|
| 42 22 250 | 1/1994 | Germany . | |
| 844416 | 8/1960 | United Kingdom | 30/169 |

*Primary Examiner*—Hwei-Siu Payer

*Attorney, Agent, or Firm*—Gary L. Griswold; Walter N. Kirn; William L. Huebsch

[57] ABSTRACT

A cutting tool adapted to be reciprocated by a manually manipulated air hammer or similar device while being used to separate laminated materials. The cutting tool comprises a blade of thin resiliently flexible metal having a sharpened edge and an opposite driven edge, and an adapter comprising a blade holder portion which may include polymeric material permanently molded around a portion of the blade adjacent its driven edge, and a shank portion shaped for engagement by the air hammer attached to the blade holder that has an end shaped for engagement by the air hammer or similar device. The majority of or all of the adapter can be formed of the polymeric material to provide a low mass for the cutting tool and an average specific gravity for the adapter that is significantly less than the specific gravity of metal.

25 Claims, 5 Drawing Sheets

CUTTING TOOL AND METHOD FOR MANUFACTURE

CROSS REFERENCE TO RELATED APPLICATIONS

This application is a continuation-in-part of U.S. patent application Ser. No. 08/235,167 filed Apr. 29, 1994 now U.S. Pat. No. 5,469,623.

FIELD OF THE INVENTION

The present invention relates to cutting tools adapted to cut the bond between laminated materials, such as between moldings and emblems on vehicle body panels, and methods for making such cutting tools.

BACKGROUND OF THE INVENTION

U.S. Pat. No. 5,219,378 describes a cutting tool comprising a blade of thin resiliently flexible clock spring steel having a first sharpened edge, and an adapter including a blade holding portion engaging a portion of blade along a driven edge opposite its sharpened edge and an elongate shank portion projecting centrally from the blade holding portion that includes a portion shaped for engagement by an air hammer. The cutting tool is adapted to be reciprocated by the air hammer while the air hammer is manually manipulated to cut the bond between moldings and emblems on vehicle body panels, which cutting can be facilitated by the use of a lubricant in the form of the liquid sold by Minnesota Mining and Manufacturing Company, St. Paul, Minn., under the trade designation "Overspray Masking Liquid". While the cutting tool described in U.S. Pat. No. 5,219,378 is reasonably effective for that purpose, its blade holder portion is of two part metal construction which makes it expensive to manufacture and gives it a significantly high mass and specific gravity.

DISCLOSURE OF THE INVENTION

The present invention provides a cutting tool adapted to be reciprocated by a manually manipulated air hammer or similar device while being used to separate laminated materials, which cutting tool is inexpensive to make and has a relatively low mass and specific gravity compared to the cutting tool described in U.S. Pat. No. 5,219,378, while being surprisingly durable and effective when used to separate laminated materials such as to separate moldings or emblems from vehicle body panels, or to separate gaskets and/or adhesive from gasket surfaces, or to separate tiles from floors or walls.

According to the present invention there is provided a cutting tool comprising a blade of thin resiliently flexible metal (e.g., 0.012 inch thick blue tempered clock spring steel) having a first sharpened edge and an opposite driven edge, and an adapter that comprises (1) a blade holder portion attached around a portion of the blade adjacent its driven edge, which blade holder portion includes a rear part abutting the driven edge and front parts extending from the rear part along portions of the major surfaces of the blade toward the sharpened edge; (2) means for retaining that portion of the blade in the blade holder portion; and (3) an elongate shank portion having a rear end, a portion adjacent the rear end shaped for engagement by the air hammer or similar device, a front end which is attached to the blade holder portion with an axis of the shank portion generally in the same plane as the imaginary centerline of the blade and with the shank portion extending generally away from the sharpened edge from its front end toward its rear end. A sufficient portion of the adapter can be formed of polymeric material (e.g., high impact ABS) to provide an average specific gravity for the adapter that is significantly less than the specific gravity of metal (i.e., less than a specific gravity of about 1.84 which is the specific gravity of magnesium). This provides a durable cutting tool that is relatively light or low in mass per inch of width of the cutting blade along its driven edge, and which is inexpensive to make compared to the cutting tool described in U.S. Pat. No. 5,219,378, while, surprisingly, being more effective in quickly cutting the bond between moldings and emblems on vehicle body panels when used in the method described in that patent. Also, because the portions of the adapter that will contact the vehicle body panels using the tool according to the present invention are of polymeric material, the tool has less tendency to mark the paint on the surface of those panels while it is being used to remove the moldings and emblems than does the cutting tool described in U.S. Pat. No. 5,219,378.

The entire adapter of the cutting tool can be formed of polymeric material having a specific gravity of about 1.03 which results in a cutting tool having a very low mass (e.g., about 2.3 ounces for a cutting tool with a 4 inch wide blade) which is quite suitable for repeated uses in removing molding and emblems from vehicle body panels and for cutting apart other laminated materials. The shank portions on cutting tools with adapters entirely of polymeric material have been found to shorten slightly during use of the cutting tools, however, and over time there has been experienced some enlargement of their end portions engaged with air hammers that makes them increasingly more difficult to engage with and disengage from air hammers. Also, shank portions made entirely of polymeric material take more time than is desirable to freeze or solidify when they are molded because of their relatively large diameters (e.g., 0.5 inch). These problems can be restricted by including in the adapter a metal rod of significantly smaller diameter (e.g., 3/16 inch) than the shank portion, which metal rod is positioned coaxially within the shank portion, has a driving end abutting the driven edge of the blade, and has a driven end at the rear end of the shank portion; and providing a thick layer of the polymeric material around the peripheral surface of the rod between its ends, which peripheral surface is rough (e.g., by being threaded) to provide good attachment of the polymeric material to the rod. Such a rod provides the advantages over an all polymeric shank portion of restricting shortening and deformation of the shank portion when the tool is used, increasing the strength of the shank portion which could be desirable in very cold weather, and allowing the polymeric material in the shank to freeze or solidify more quickly when it is molded because of its reduced thickness. The resultant adapter on the cutting tool still also has an average specific gravity of about 1.44 which is relatively low when compared to an adapter of the same size and volume made of metal, and affords a low mass for the tool (e.g., about 2.8 ounces for a cutting tool with a 4 inch wide blade).

A method for making the cutting tool according to the present invention is to provide the blade, and molding polymeric material around the end portion of the blade and extending away from that end portion to form the adapter. When the metal rod is included, the method further includes positioning the rod coaxially within a portion of a mold in which the elongate shank portion is to be molded with the driving end of the rod abutting the driven edge of the blade and the driven end of the rod at the end of the mold in which the rear end of the shank portion is to be molded so that a layer of the polymeric material will be molded around the peripheral surface of the rod between the ends of the rod during the molding step. This can be facilitated by providing the blade with a notch centrally along its driven edge, and positioning the portion of the metal rod adjacent its driving end within the notch with the driving end of the rod abutting the driven edge of the blade.

BRIEF DESCRIPTION OF THE DRAWING

The present invention will now be described with reference to the accompanying drawing wherein like reference numerals identify like parts in the several views, and wherein.

DETAILED DESCRIPTION

Figure 1:
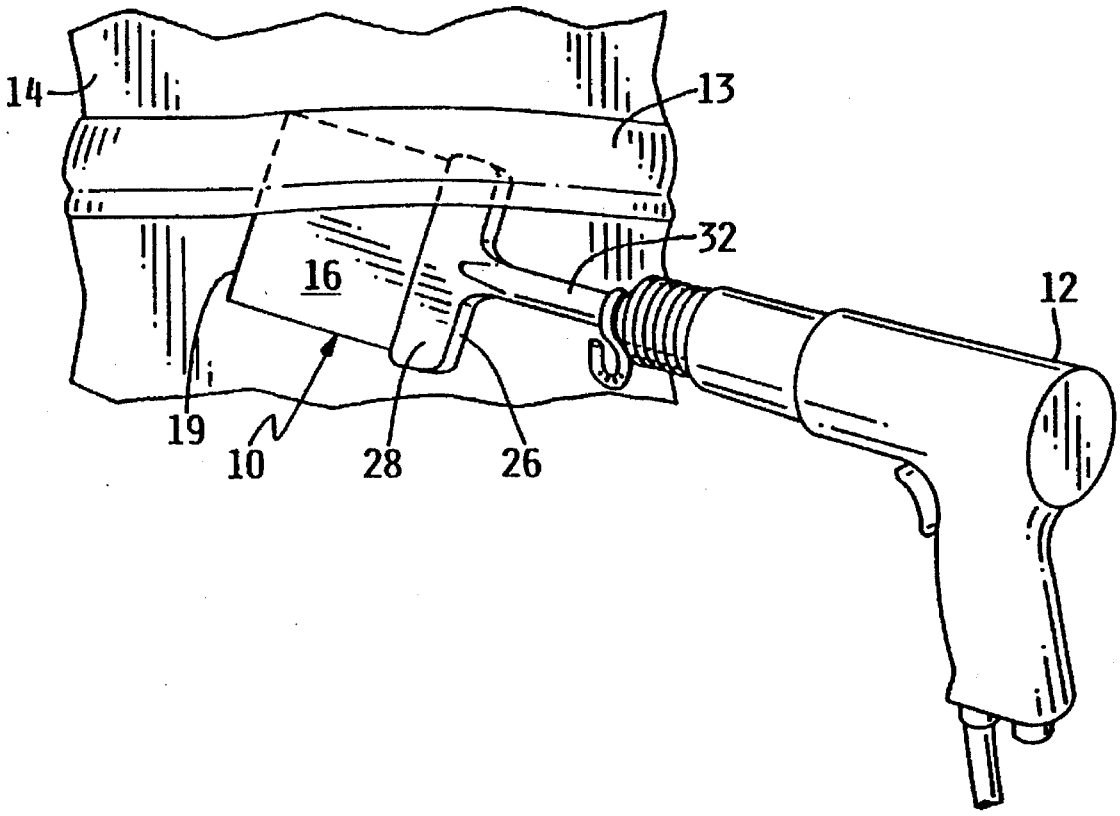
FIG. 1 is a perspective view of a cutting tool according to the present invention coupled to an air hammer and being used to remove a piece of molding from a body panel.
Figure 2:
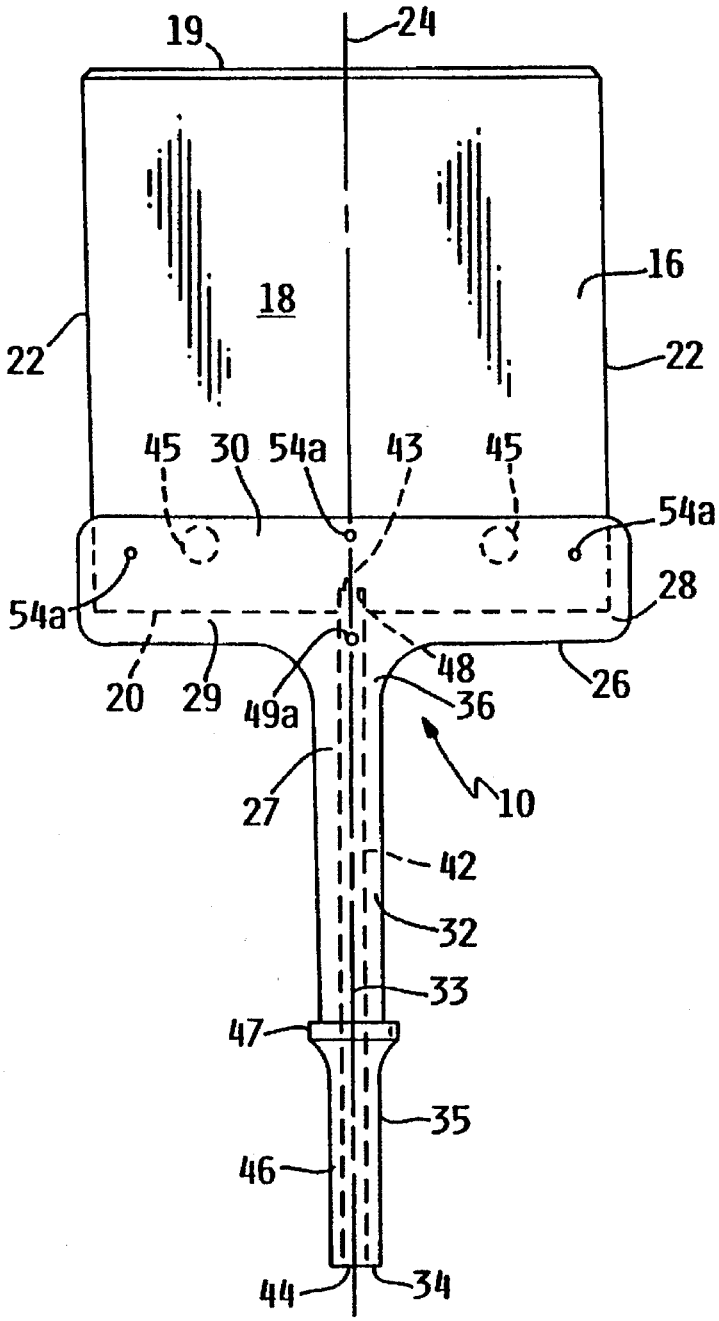
FIG. 2 is an enlarged plan view of the cutting tool illustrated in FIG. 1.
Figure 3:
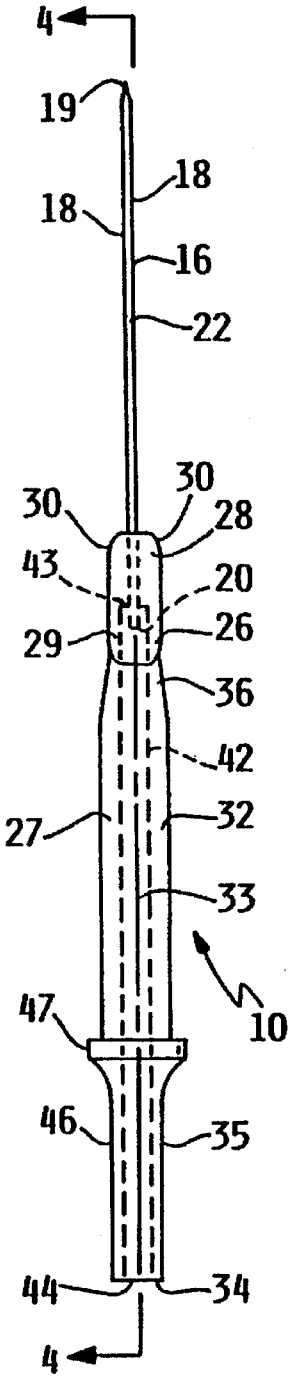
FIG. 3 is a side view of the cutting tool of FIG. 1.
Figure 4:
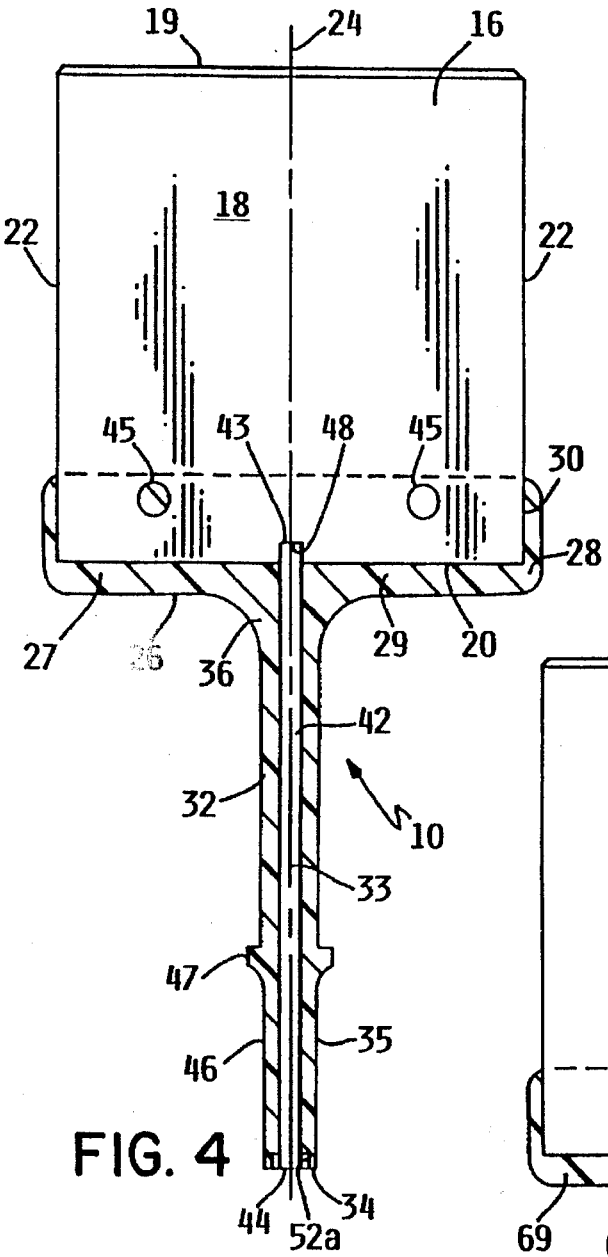
FIG. 4 is a sectional view taken approximately along line 4—4 of FIG. 3.

Referring now to FIGS. 1 through 4 of the drawing there is illustrated a cutting tool 10 according to the present invention that is illustrated being reciprocated by a manually manipulated air hammer 12 while being used to separate laminated materials illustrated as a molding 13 adhered on a body panel 14 of an automobile. The cutting tool 10 comprises a rectangular blade 16 of thin resiliently flexible metal which can be, for example, a square, 4 inch by 4 inch piece of blue tempered clock spring steel, 0.012 inch thick, but could be of different metal such as full hard stainless steel shim stock or beryllium copper. The blade 16 has opposite major surfaces 18, a first or sharpened edge 19, and a second or driven edge 20 opposite its sharpened edge 19. Also, the blade 16 has opposite side edges 22 extending between the sharpened and driven edges 19 and 20, and an imaginary centerline 24 about midway between the side edges 22 and extending between its sharpened and driven edges 19 and 20.

The cutting tool 10 also includes an adapter 26 comprising an outer layer 27 of polymeric material. The adapter 26 includes a blade holder portion 28 in which the outer layer 27 of polymeric material is permanently molded around a portion of the blade 16 adjacent its driven edge 20. The holding portion includes a rear part 29 abutting the driven edge 20 and front parts 30 extending from the rear part 29 along portions of the major surfaces 18 of the blade 16 a short distance toward its sharpened edge 19. The adapter 26 also includes an elongate shank portion 32 having an axis 33, a rear end 34, an air hammer engageable portion 35 adjacent its rear end 34 of a conventional shape adapted for engagement by the air hammer 12 (but which could alternatively be shaped for engagement with a similar tool), and a front end 36 axially spaced from and opposite the rear end 34 that is attached to the blade holder portion 28 with the axis 33 of the shank portion 32 generally in the same plane normal to the surfaces 18 of the blade 16 as the imaginary centerline 24 of the blade 16 and the shank portion 32 extending from its front end 36 toward its rear end 34 generally away from the sharpened edge 19 of the blade 16. As illustrated, the axis 33 of the shank portion 32 is generally parallel with the major surfaces 18 of the blade 16. Alternatively, however, the axis 33 of the shank portion 32 could be disposed at an angle somewhere between about 135 degrees and 180 degrees with respect to the major surfaces 18 of the blade 16 such as an angle of about 160 degrees as is illustrated in U.S. Pat. No. 5,219,378 between the shank portion 31 and blade 33 illustrated in that patent.

The majority of the adapter 26 is formed by the layer 27 of polymeric material. In addition to the layer 27 of polymeric material, the adapter 26 comprises an elongate metal rod 42 (e.g., an about 3/16 inch diameter, 5.15 inch long steel rod which is solid as illustrated, but alternatively could be hollow or tubular). The rod 42 is positioned coaxially within the elongate shank portion 32, has a driving end 43 abutting the driven edge 20 of the blade 16, and has a driven end 44 exposed at the rear end 34 of the shank portion 32. The layer 27 of polymeric material extends around the peripheral surface of the rod 42, which layer 27, when measured from the axis 33 of the shank portion 32, has a radial thickness (e.g., 0.16 inch) that is greater than (e.g., about 1.7 times greater than) the radial dimension (e.g., 0.094 inch) of the rod 42. The combination of the layer 27 of polymeric material and the rod 42 provide an average specific gravity for the adapter 26 of no greater than about 1.5 that is significantly less than the specific gravity for an adapter of the same size and volume made of metal. Also, the combination of the layer 27 of polymeric material and the rod 42 provide a very low mass for the tool 10 (i.e., about 1.62 ounces total when the blade 16 is about 1 inch long along its driven edge 20; about 2.54 ounces total or 0.85 ounce per inch of length of the driven edge 20 of the blade 16 when the blade 16 is about 3 inches long along its driven edge 20; and about 3 ounces total or 0.74 ounce per inch of length of the driven edge 20 of the blade 16 when, as illustrated, the blade 16 is about 4 inches long along its driven edge 20). While a cutting tool with those weights or less per inch of length of the driven edge 20 of the blade 16 are preferred, it is expected that cutting tools with weights per inch of length of the driven edge 20 of the blade 16 one and one half, two, or even three times in excess of these values would still provide the advantages of efficient cutting provided by the cutting tool 10 embodiment described above. As an example, the cutting tool illustrated with weights per inch of length of the driven edge 20 of the blade 16 three times in excess of these values would weigh about 4.86 ounces total when the blade 16 is about 1 inch long along its driven edge 20; about 7.64 ounces total or 2.55 ounces per inch of length of the driven edge 20 of the blade 16 when the blade 16 is about 3 inches long along its driven edge 20; and about 9 ounces total or 2.22 ounces per inch of length of the driven edge 20 of the blade 16 when, as illustrated, the blade 16 is about 4 inches long along its driven edge 20, which would be less than half the weight of the same cutting tool when the adapter was solid and made entirely of iron or steel.

The layer 27 of polymeric material should be of a high impact polymeric material such as acrylonitrile butadiene styrene, polypropylene, polyester, polycarbonate, acetyl, or nylon, etc.

As illustrated, the blade holder portion 28 is permanently molded around the portion of the blade 16 adjacent its driven edge 20, is generally rectangular in cross section, and has a thickness measured in a direction normal to the major surfaces 18 of the blade of about 0.4 inch, with the front parts 30 extending from the rear part 29 along portions of the major surfaces 18 of the blade 16 having about equal thicknesses measured in directions normal to the major surfaces 18. The front parts 30 extend from the rear part 29 about 0.7 inch along portions of the major surfaces 18 of the blade 16, and extend the same distance along the side edges 22 of the blade 16. The blade 16 has two through openings 45 (e.g., 0.375 inch diameter openings 45) spaced a short distance from its driven edge 20 through which extend portions of the layer 27 of polymeric material that join the front parts 30 of the blade holder portion 28 and help hold the blade 16 in place. Alternatively, while not illustrated, the blade holder portion 28 could be molded to provide a socket that closely receives the portion of the blade 16 adjacent its driven edge 20, while allowing the blade 16 to be removed from or inserted in that socket; and the blade 16 could be releasably held in place in that socket by fasteners (not shown) such as bolts or screws that pass through the front parts 30 of the blade holder portion 28 and the openings 45. The rear part 29 of the blade holder portion 28 that abuts the driven edge 20 of the blade 16 has a width measured in the plane of one of the major surfaces 18 of the blade 16 and in a direction generally normal to the driven edge 20 of at least about 0.3 inch. The conventional shape of the portion 35 adapted for engagement by the air hammer 12 includes a cylindrical engagement part 46 adjacent the rear end 34 of the shank portion 32 that is about 0.4 inch in diameter and about 1.25 inches long, a spring retention collar part 47 at its end opposite the rear end 34 that is axially about 0.2 inch long and has diameter of about 0.75 inch, and a generally conical transition part between the engagement part 46 and the collar part 47.

Preferably the rod 42 has a rough peripheral surface to provide driving engagement between the rod 42 and the layer 27 of polymeric material. Without such a rough peripheral surface the rod 42 can slide axially relative to the layer 27 of polymeric material when the cutting tool 10 is driven by an air hammer, thereby transferring most of the driving force from the air hammer to the driven edge 20 of the blade 16 through the rod 42 alone and causing the driving end 43 of the rod 42 to cut into the blade 16. With a sufficiently rough surface on the rod 42, however, the force transmitted to the rod 42 by such an air hammer will not cause the rod 42 to slide within the layer 27 of polymeric material, but instead will cause that force to be transmitted into the layer 27 of polymeric material so that both the rod 42 and the layer 27 of polymeric material apply that force to the driven edge 20 of the blade 16. The rough peripheral surface on the rod 42 can be formed or provided in many ways. One inexpensive and effective way to form the rough peripheral surface on the rod 42 is by cutting or rolling conventional threads around the periphery of the rod 42. Forming square threads or axially spaced rings around the rod 42 would also be effective, as would knurling the peripheral surface of the rod 42, cutting slots in the rod 42 in a direction transverse to the axis of the rod 42, or boring sockets into or passageways through the rod 42 in directions generally right angles to its axis.

Figure 5:
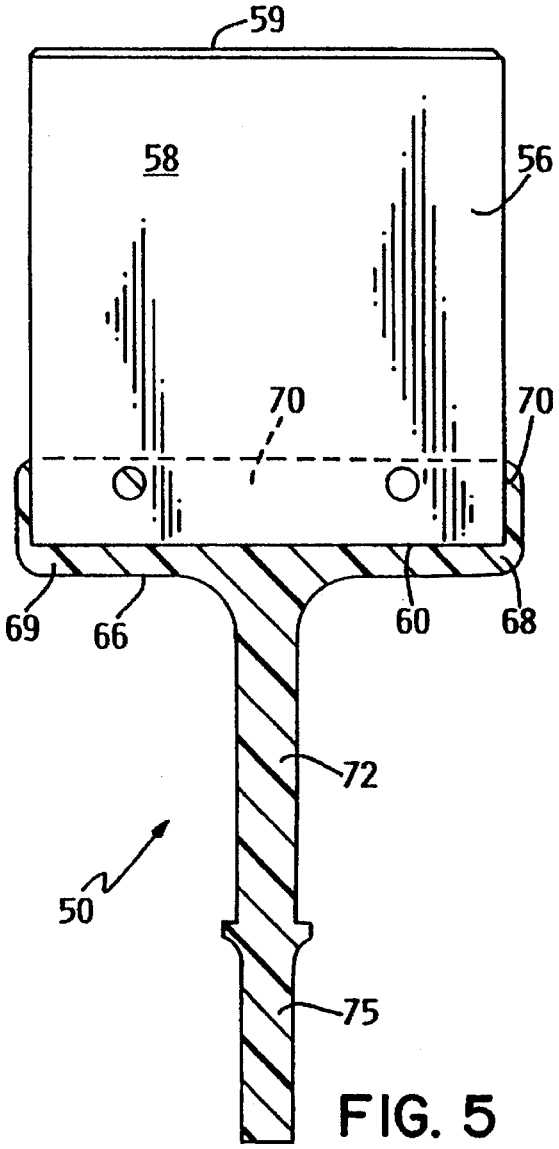
FIG. 5 is a sectional view similar to FIG. 4 that illustrates an alternate embodiment of the cutting tool according to the present invention.

FIG. 5 illustrates a cutting tool generally designated by the reference numeral 50 which is essentially the same as the cutting tool 10 except that it does not include a rod like the rod 42 used in the tool 10. The cutting tool 50, like the tool 10, comprises a rectangular blade 56 of thin resiliently flexible metal having opposite major surfaces 58, a first or sharpened edge 59, and a second or driven edge 60 opposite its sharpened edge 59. The cutting tool 50 also includes an adapter 66 consisting only of polymeric material. The adapter 66 includes a blade holder portion 68 permanently molded around a portion of the blade 56 adjacent its driven edge 60 including a rear part 69 abutting the driven edge 60 and front parts 70 extending from the rear part 69 along portions of the blade 56 a short distance toward its sharpened edge 59; and an elongate shank portion 72 having an air hammer engageable portion 75 adjacent its rear end shaped in a conventional shape for engagement by the air hammer 12.

Since the entire adapter 66 is formed of polymeric material, the adapter 66 has an average specific gravity of about 1.03 that is significantly less than the specific gravity for an adapter of the same size and volume made of metal. Also, because the entire adapter 66 is formed of polymeric material, the cutting tool has a very low mass (i.e., about 1 ounce when the blade 56 is about 1 inch long along its driven edge 60; about 1.9 ounce or 0.64 ounce per inch of length of the driven edge 60 of the blade 56 when the blade 56 is about 3 inches long along its driven edge 60; and about 2.3 ounce or 0.57 ounce per inch of length of the driven edge 60 of the blade 56 when, as illustrated, the blade 56 is about 4 inches long along its driven edge 60).

Figure 6:
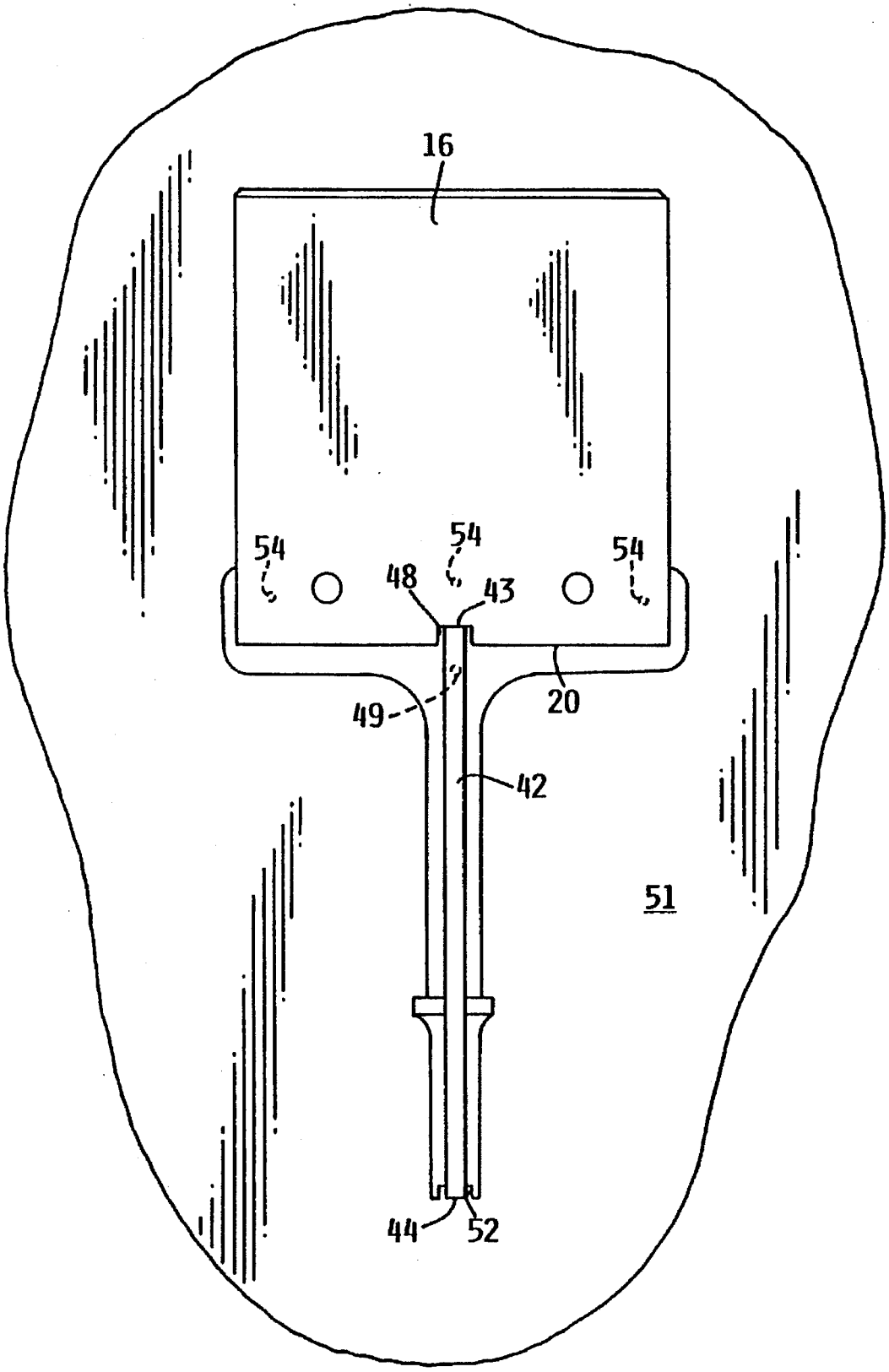
FIG. 6 is a schematic view illustrating a mold used in a method of making the embodiment of the cutting tool according to the present invention illustrated in FIGS. 1 through 4.

The lower half of a mold 51 used in a method according to the present invention for making the cutting tool 10 is illustrated in FIG. 6. That method comprises providing the mold 51, the rod 42 and the blade 16; and using the mold 51 to mold the layer 27 of polymeric material around the end portion of the blade 16 adjacent its driven edge 20 and around the rod 42 to form the adapter 26. Prior to molding of the adapter 26, the rod 42 is positioned coaxially within a portion of the mold 51 in which the elongate shank portion 32 is to be molded with the driving end 43 of the rod 42 abutting the driven edge 20 of the blade 16 and the driven end 44 of the rod 42 at the end of the mold in which the rear end 34 of the shank portion 32 is to be molded so that the layer of polymeric material 27 will be molded around the peripheral surface of the rod 42 during the molding process. The blade 16 has a notch 48 defined by a central portion of the driven edge 20 that is adapted to receive a portion of the metal rod 42 adjacent its driving end 43, and during the positioning portion of the molding step that portion of the metal rod 42 is positioned within the notch 48 with the driving end 43 of the rod 42 abutting the driven edge 20 of the blade 16. The end of the rod 42 to be positioned at the rear end 34 of the adapter 26 is supported by a collar-like portion 52 of the mold 51 that forms an annular groove **52*a* in the adapter 26 at its rear end 34. The opposite end of the rod 42 is positioned in the notch 48 by opposed pins 49 in the mold 51 (only one of which is shown) that engage opposite sides of the rod 42. The pins 49, upon being withdrawn from the molded cutting tool 10, leave small openings 49*a* in the adapter 26 (see FIG. 2). Also, two sets of three small opposed pins 54 engage opposite sides of the portion of the blade 16 projecting into the mold 51 to insure that that portion of the blade 16 remains flat during the molding process. The pins 54, upon being withdrawn from the molded cutting tool 10, leave small openings 54*a* in the adapter 26 (see FIG. 2**).

Figure 7:
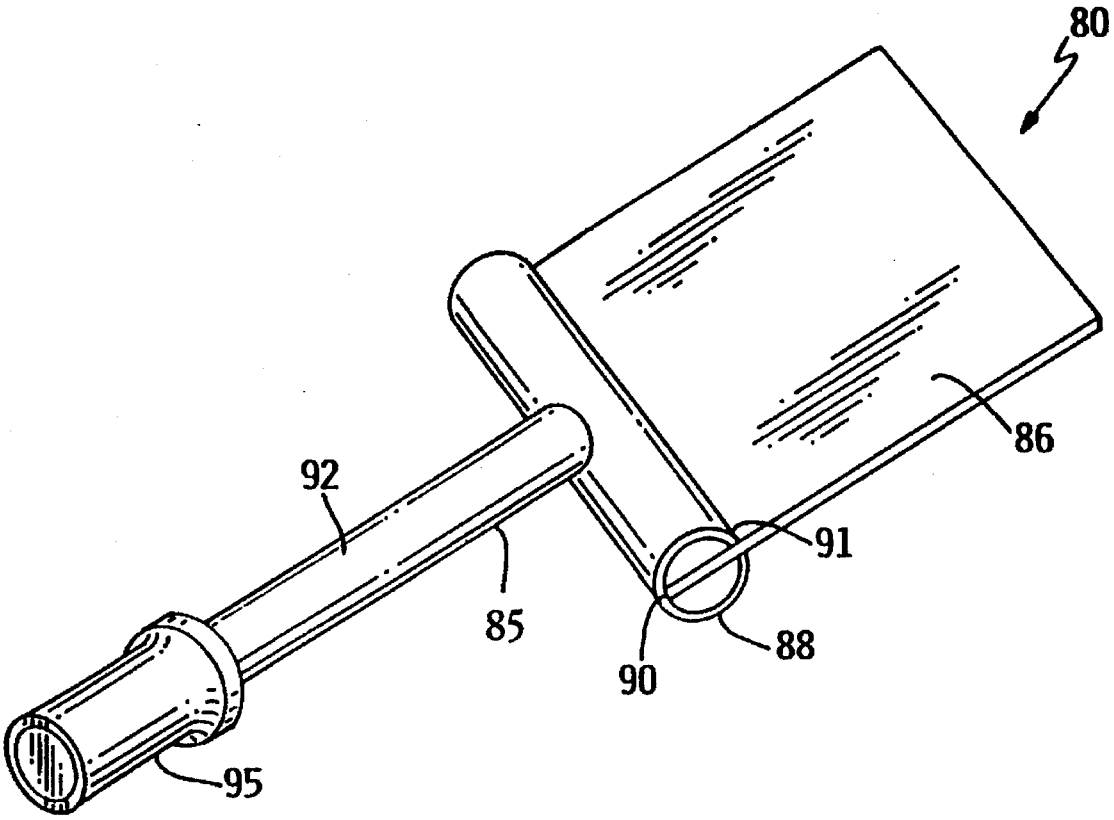
FIG. 7 is a perspective view illustrating a third possible alternate embodiment of the cutting tool according to the present invention.

The present invention has now been described with reference to two embodiments thereof. It will be apparent to those skilled in the art that many changes can be made in the embodiment described without departing from the scope of the present invention. For example, for greater durability the air hammer engageable portion 35 in the tool 10 could be formed entirely of metal (e.g., aluminum or steel) and could be integral with the rod 42. Also, while it has not yet been built, we expect that a cutting tool according to the present invention could be made to have a mass within the limits claimed herein, and thereby provide the advantages of efficient cutting provided by the cutting tools 10 and 50 described above, by forming an adapter for that cutting tool from metal. One possible structure for such a cutting tool 80 is illustrated in FIG. 7 where an adapter 85 for the cutting tool 80 is made from hollow metal tubes 88 and 92 welded together to form a T, with the blade holding tube 88 that forms the cross bar of the T receiving an end portion adjacent a driven edge 90 of a blade 86 of the type described above through a slot 91 along the side of the tube 88 opposite the other shank forming tube 92 with the driven edge 90 of the blade 86 against the inner wall of the tube 88. The blade 86 is held in the tube 88 either by set screws (not shown) through the tube 88 or welding between the tube 88 and the blade 86. The shank forming tube 92 has a hollow spool-like metal air hammer engageable portion 95 welded about its outer surface at the rear end of the shank forming tube 92. Thus the scope of the present invention should not be limited to the structures described in this application, but only by structures described by the language of the claims and the equivalents of those structures.

We claim:

1. A cutting tool for use in a manually manipulated air hammer while the cutting tool is reciprocated by the air hammer and used to separate laminated materials, said cutting tool comprising:

a blade of thin resiliently flexible metal, said blade having opposite major surfaces, a first sharpened edge, and a driven edge opposite said sharpened edge, opposite side edges extending between said sharpened and driven edges, and an imaginary centerline midway between said side edges extending between said sharpened and driven edges; and an adapter comprising a blade holder portion comprising polymeric material around a portion of said blade adjacent said driven edge, said blade holder portion including a rear part abutting said driven edge and front parts extending from said rear part along portions of said major surfaces of said blade toward said sharpened edge;

means for retaining said portion of said blade adjacent said driven edge in said blade holder portion; and an elongate shank portion having an axis, said shank portion having a rear end, a portion adjacent said rear end shaped for engagement by said air hammer, and a front end axially spaced from and opposite said rear end, said front end being attached to said blade holder portion with said axis of said shank portion generally in the same plane as the imaginary centerline of said blade, and said shank portion extending generally away from said sharpened edge from said front end toward said rear end, said shank portion including a metal rod having an axis, said rod being positioned coaxially within said elongate shank portion, having a driving end abutting the driven edge of said blade, having a driven end at the rear end of said shank portion, and having a peripheral surface between said driving and driven ends, said elongate shank portion also including a layer of polymeric material around the peripheral surface of said rod, and said peripheral surface of said rod being rough to provide firm engagement between the peripheral surface of said rod and said layer of polymeric material with respect to impact forces applied to the driven end of said rod.

2. A cutting tool according to claim 1 wherein, when measured from the axis of said shank portion, the radial thickness of said layer of said polymeric material around the peripheral surface of said rod is greater than the radial dimension of said rod.

3. A cutting tool according to claim 1 wherein the average specific gravity for said adapter is less than about 1.84.

4. A cutting tool according to claim 1 wherein the average specific gravity for said adapter is no greater than about 1.44.

5. A cutting tool according to claim 1 wherein the blade holder portion around said portion of the blade adjacent said driven edge is generally rectangular in cross section having a thickness measured in a direction normal to said major surfaces of said blade of at least about 0.4 inch, with said front parts extending from said rear part along portions of said major surfaces of said blade having about equal thicknesses measured in directions normal to said major surfaces, and said rear part of said blade holder portion abutting said driven edge of said blade has a width measured in the plane of one of the major surfaces of said blade and in a direction generally normal to said driven edge of at least about 0.3 inch.

6. A cutting tool according to claim 1 wherein the axis of said shank portion is generally parallel with the major surfaces of said blade.

7. A cutting tool according to claim 1 wherein said blade is about 4 inches wide, and is of blue tempered clock spring steel about 0.012 inch thick.

8. A cutting tool according to claim 1 wherein said means for retaining said portion of said blade adjacent said driven edge in said blade holder portion is provided by said polymeric material in said blade holder portion being permanently molded around said portion of said blade adjacent said driven edge, and said portion of said blade adjacent said driven edge having through openings through which said polymeric material extends to help retain said portion of said blade adjacent said driven edge in said blade holder portion.

9. A cutting tool according to claim 1 wherein said rod is threaded to provide said rough peripheral surface.

10. A cutting tool according to claim 1 wherein said rod has axially spaced rings around the rod to provide said rough peripheral surface.

11. A cutting tool according to claim 1 wherein said rod is knurled to provide said rough peripheral surface.

12. A cutting tool according to claim 1 wherein said rod has slots in a direction transverse to the axis of the rod to provide said rough peripheral surface.

13. A cutting tool according to claim 1 wherein said rod has sockets extending into the rod in directions transverse to the axis of the rod to provide said rough peripheral surface.

14. A cutting tool according to claim 1 wherein said rod has passageways extending through the rod in directions transverse to the axis of the rod to provide said rough peripheral surface.

15. A method for making a cutting tool to be used in a manually manipulated air hammer while the cutting tool is reciprocated by the air hammer and used to separate laminated materials, said method comprising:

providing a blade of thin resiliently flexible metal, said blade having opposite major surfaces, a first sharpened edge, and a driven edge opposite said sharpened edge, opposite side edges extending between said sharpened and driven edges, and an imaginary centerline midway between said side edges extending between said sharpened and driven edges; and molding polymeric material to form an adapter comprising a blade holder portion around a portion of said blade adjacent said driven edge including a rear part abutting said driven edge and front parts extending from said rear part along portions of said major surfaces of said blade toward said sharpened edge; and an elongate shank portion having an axis, said shank portion having a rear end, a portion adjacent said rear end shaped for engagement by said air hammer, and a front end axially spaced from and opposite said rear end, said front end being attached to said blade holder portion with said axis generally in the same plane as the imaginary centerline of said blade, and said shank portion extending generally away from said sharpened edge from said front end toward said rear end;

said molding step including the steps of providing a metal rod having an axis, axially spaced driving and driven ends, and a rough peripheral surface between the ends; and positioning the rod coaxially within a portion of a mold in which the elongate shank portion is to be molded with the driving end of the rod abutting the driven edge of the blade and the driven end of the rod at the end of the mold in which the rear end of the shank portion is to be molded so that a layer of the polymeric material will be molded around the rough peripheral surface of the rod between the ends of the rod during the molding step.

16. A method according to claim 15 wherein said molding step is performed so that the majority of said adapter is formed of polymeric material to provide an average specific gravity for said adapter that is less than about 1.84.

17. A method according to claim 15 wherein, when measured along a radius of the shank portion, the radial thickness of the layer of polymeric material around the peripheral surface of the rod formed during the molding step is greater than the radial dimension of the rod.

18. A method according to claim 15 wherein in said providing step said blade is provided with a notch centrally along said driven end adapted to receive a portion of said metal rod adjacent said driving end, and in said positioning step the portion of said metal rod adjacent said driving end is positioned within said notch with the driving end of the rod abutting the driven edge of the blade.

19. A cutting tool according to claim 15 wherein in the molding step the axis of the shank portion is generally parallel with the major surfaces of the blade.

20. A method according to claim 15 further including the step of threading the rod to provide said rough peripheral surface.

21. A method according to claim 15 further including the step of forming axially spaced rings around the rod to provide said rough peripheral surface.

22. A method according to claim 15 further including the step of knurling the rod to provide said rough peripheral surface.

23. A method according to claim 15 further including the step of slotting the rod in a direction transverse to the axis of the rod to provide said rough peripheral surface.

24. A method according to claim 15 further including the step of forming sockets in the rod extending into the rod in directions transverse to the axis of the rod to provide said rough peripheral surface.

25. A method according to claim 15 further including the step of forming passageways in the rod extending through the rod in directions transverse to the axis of the rod to provide said rough peripheral surface.

* * * * *